US008266932B2

(12) United States Patent
Longwell

(10) Patent No.: US 8,266,932 B2
(45) Date of Patent: Sep. 18, 2012

(54) THEFT DETERRENT LOCKING HASP

(76) Inventor: Danny Longwell, Durant, OK (US)

( * ) Notice: Subject to any disclaimer, the term of this patent is extended or adjusted under 35 U.S.C. 154(b) by 0 days.

(21) Appl. No.: 13/325,033

(22) Filed: Dec. 13, 2011

(65) Prior Publication Data

US 2012/0144883 A1 Jun. 14, 2012

Related U.S. Application Data

(60) Provisional application No. 61/422,713, filed on Dec. 14, 2010.

(51) Int. Cl.
*E05B 67/38* (2006.01)

(52) U.S. Cl. ..... 70/56; 70/2; 70/6; 70/54

(58) Field of Classification Search ..... 292/281; 70/2, 6, 52–56, 417
See application file for complete search history.

(56) References Cited

U.S. PATENT DOCUMENTS

| | | | | |
|---|---|---|---|---|
| 3,392,555 | A | 7/1968 | Beaver | |
| 3,652,114 | A | 3/1972 | Cady | |
| 3,744,280 | A | 7/1973 | Brown, Jr. | |
| 3,884,057 | A | 5/1975 | Maurer | |
| 4,033,155 | A | 7/1977 | De Lucia | |
| 4,033,156 | A * | 7/1977 | Cottingham | 70/56 |
| 4,322,102 | A | 3/1982 | Lindblom | |
| 4,437,692 | A * | 3/1984 | Halopoff | 292/57 |
| 4,535,612 | A * | 8/1985 | Seremet | 70/56 |
| 4,566,296 | A * | 1/1986 | Kochakis | 70/56 |
| 4,581,907 | A | 4/1986 | Eberly | |
| 4,629,230 | A * | 12/1986 | Tegg | 292/281 |
| 4,745,783 | A | 5/1988 | Poe | |
| 4,793,163 | A * | 12/1988 | MacFarlane et al. | 70/2 |
| 4,843,845 | A | 7/1989 | Poe | |
| 4,852,920 | A * | 8/1989 | DeForrest, Sr. | 292/205 |
| 4,873,849 | A | 10/1989 | Goodson | |
| 4,879,889 | A * | 11/1989 | DeForrest, Sr. | 70/56 |
| 4,896,518 | A * | 1/1990 | Appelgren | 70/54 |
| 4,926,662 | A * | 5/1990 | Gaudet | 70/56 |
| 5,092,143 | A * | 3/1992 | Rumbles | 70/56 |
| 5,172,574 | A * | 12/1992 | Perfetto | 70/56 |
| 5,426,959 | A * | 6/1995 | Kies | 70/56 |
| 5,477,710 | A * | 12/1995 | Stefanutti | 70/56 |
| 6,058,745 | A * | 5/2000 | Sanchez | 70/56 |
| 6,439,008 | B1 * | 8/2002 | Keil | 70/56 |
| 6,578,393 | B2 * | 6/2003 | Yarborought | 70/56 |

* cited by examiner

*Primary Examiner* — Suzanne Barrett
(74) *Attorney, Agent, or Firm* — Daniel Boudwin; Alex Boyer

(57) ABSTRACT

A theft deterrent hasp assembly for shrouding the shackle of a pad lock device. The disclosed hasp comprises a hingeable arm having a protective shroud at its distal end and a pad lock hoop engagement hole. The engagement hole is positioned at an angle with regard to the length of the hingeable hasp and along a diagonal within the shroud enclosure to allow improved access for pad lock shackle insertion therein. This access allows the shackle to be more easily inserted into a pad lock hoop protruding through the engagement hole of the hasp after placement thereover, while the protective shroud provides plurality of upstanding members that form a three sided structure for protection against tampering. The shroud members are adapted to cover a majority of the padlock shackle while in use, preventing cutting tools or saw blades from achieving access thereto while in a locked position.

4 Claims, 2 Drawing Sheets

THEFT DETERRENT LOCKING HASP

CROSS REFERENCE TO RELATED APPLICATION

This application claims the benefit of U.S. Provisional Application No. 61/422,713 filed on Dec. 14, 2010, entitled "High Security Hasp."

BACKGROUND OF THE INVENTION

1. Field of the Invention

The present invention relates to a security locking means and theft deterrent for pad locks and hasps. More specifically, the present invention pertains to a high security hasp that prevents bolt cutter and similar cutting tool access to the shackle of a padlock or combination lock.

2. Description of the Prior Art

Pad lock hasps are devices that are utilized to span a gap between hingeable doors or between a door and a doorway jamb for the purposes of providing a physical connection that prevents the door from opening once the door has been closed and the hasp has been engaged. These are locking or access denial devices that prevent unwanted entry to individuals without a key or combination to unlock and unshackle the padlock from the hasp. Common locations for these devices include residential and commercial doorways, tractor trailer rear doors and on smaller installations on devices such as safes and lock boxes.

Hasps generally comprise of a padlock shackle hoop, which is located on a first surface and provides a closed, U-shaped securement location for the shackle of a padlock. Located on an adjacent surface, such as the door jamb or door itself, is a hingeable arm that provides a means to accept the hoop through a shackle hoop engagement hole. Once engaged, a padlock is fitted through the hoop to lock the arm into position, preventing the hingeable arm from disengaging the hoop, and therefore preventing the two surfaces (a door surface and an adjacent surface) from moving relative to one another. In this way, two doors can be locked into position together or a door can be locked against an adjoining jamb. Removal of the padlock requires a key access or combination, which allows the shackle to be released and subsequent disengagement from the hasp hoop.

The common problem relating to these devices is the inherent access to the locking means, and those that would attempt to destroy or otherwise circumvent the key access or number combination access. Specifically, the shackle of the padlock is exposed in many common hasps, which allows a thief or intruder to physically cut the shackle along its length using a number of tools that provide a mechanical advantage. Bolt cutters, hacksaws and similar cutting devices easily defeat a padlock shackle, even one made of hardened material that resists tampering. The present invention is a device that shrouds the exposed regions of a padlock shackle, wherein the shroud is provided along the distal end of the hingeable arm of the hasp. The shrouds are located in close proximity to the shackle, while extending around a majority of its exposed surface area to eliminate access to tools that would otherwise defeat the shackle when installed.

Devices have been disclosed in the prior art that describe padlock shackle protection devices and hasps having tamper deterrent elements. These devices have similar structural and design elements for the purposes of preventing unauthorized access to a padlock shackle, with varying levels of protection and means for accomplishing that end. While effective devices and being particularly suited for their given requirements, these devices fail to disclose the elements of the present invention. The present security hasp provides complete coverable of a padlock shackle, fulfilling a need in the art yet to be disclosed or capitalized on.

Specifically, U.S. Pat. No. 4,745,783 to Poe is a device that discloses a tamper proof hasp device for use with a padlock incorporating a U-shaped and pivotable shackle. A first and second hasp plates are formed at one end with an opening for receipt of a shackle pivot leg. Guard plates projecting from the hasps plates restrict access to the attached shackle with tools such as bolt cutter, hacksaw and similar devices. The Poe device provides a shackle guard for a padlock with guards comprising upstanding and downward projecting outer surfaces, blocking direct access to the padlock shackle. The shackle is adapted to fit through both hasp plates, while the guards are shaped in such a way that the periphery access to the shackle is limited. The design of this shackle guard is significantly different from the present invention, which provides upstanding guards around a significant portion thereof, wherein the shackle must be attached within the enclosed boundary to prevent tampering or tool access.

U.S. Pat. No. 4,843,845 also to Poe further describes a shackle guard for a conventional padlock that is attachable to the open shackle prior to being secured into a closed, locked position. The device comprises a protector cover having an outer wall, and inward engagement clips that connect between the lock shackle when in an open configuration and access within its open, inverted U-shape is available. Once in a locked position, the shackle guard engagement clips are secured to the shackle, while its outer protector cover shrouds the padlock and shackle from visualization or tampering. A keeper wire is attached to the guard to maintain its position along a wall surface when not in use. The '845 Poe device is a novel shackle guard that works in conjunction with an open shackle, wherein its connection is achieved when the shackle an open position and secure when in a locked position. The guards are not part of an assembly that is attachable to a wall or part of a hasp, but rather is an independent shroud that may be attached to the padlock in any location.

Further still, U.S. Pat. No. 4,322,102 to Lindblom discloses a guard for protecting the shackle of a padlock comprising a U-shaped member having plate limbs, wherein the shackle is placed between the limbs. The limbs are two upstanding members that provide shrouds on opposing sides of a padlock shackle, preventing tampering or access thereto. The upstanding members require the padlock to be oriented perpendicularly from a wall surface, wherein the members shroud the fore and aft sides of the shackle while in a locked position. The present invention provides a hasp having a shackle guard wherein the orientation of the padlock may be parallel to the wall surface, and access is limited to the shackle length to prevent tampering. Its structure is sufficiently differentiated from the Lindblom device.

U.S. Pat. No. 4,581,907 to Eberly is another device that describes a protective device for padlocks that is adapted to interlock coordinating members to protect the padlock parts from unauthorized release or tampering with a cutting tool. A recess between interlocking members receives the shackle of a padlock in a similar fashion as the Lindblom device, wherein the fore and aft faces of the shackle are shrouded. The Eberly device, however, is adapted for providing a hasp having a hingeable arm comprising one of two elements that comprise the protective shroud. The structure and construction of the device differs in elements from the present invention, wherein a hasp having a three-sided shroud is provided for protecting a padlock hasp when positioned between the padlock and the hasp ring.

Finally, U.S. Pat. No. 3,884,057 to Maurer describes an apparatus for protecting a bolt of a lock from being cut, comprising a hasp and cross members, the cross member having a bulkhead or protective wall to prevent access to the bolt. The hasp is engaged by the padlock bolt, which is shrouded by the protective wall. While providing a hingeable hasp and protection for a padlock shank, the Maurer device fails to provide sufficient coverage therearound to prevent access with a bolt cutter or similar cutting tool. The hasp is located along the periphery or open section of the protective wall, allowing the lock to be rotated into a position that would reveal a section of its shank. The present invention provides a protective shroud that encloses a padlock shank from all side and prevents access thereto.

The preceding prior art devices are disclosed for the purposes of differentiating the present invention from the devices currently available to the public. These devices are considered the most relevant to the present disclose, and it is submitted that these devices are substantially divergent in design and structural elements. Consequently it is clear that there is a need in the art for an improvement to existing security hasp devices. In this regard the instant invention substantially fulfills these needs.

SUMMARY OF THE INVENTION

In view of the foregoing disadvantages inherent in the known types of security hasp devices now present in the prior art, the present invention provides a new security hasp wherein the same can be utilized for providing convenience for the user when protecting the shackle of an exposed padlock attached to a door hasp.

It is therefore an object of the present invention to provide a new and improved security hasp device that has all of the advantages of the prior art and none of the disadvantages.

Another object of the present invention to provide a security hasp device having a means to protect the exposed regions of a padlock shackle while installed.

Another object of the present invention is to provide a security hasp with upstanding shroud members that prevent cutting tool access to a padlock shackle.

Yet another object of the present invention is to provide a security hasp with a design that allows the padlock shackle to be easily engaged onto the hasp loop and with a plurality of shrouds.

A final object of the present invention is to provide a security hasp that is of simple construction that can be easily produced.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
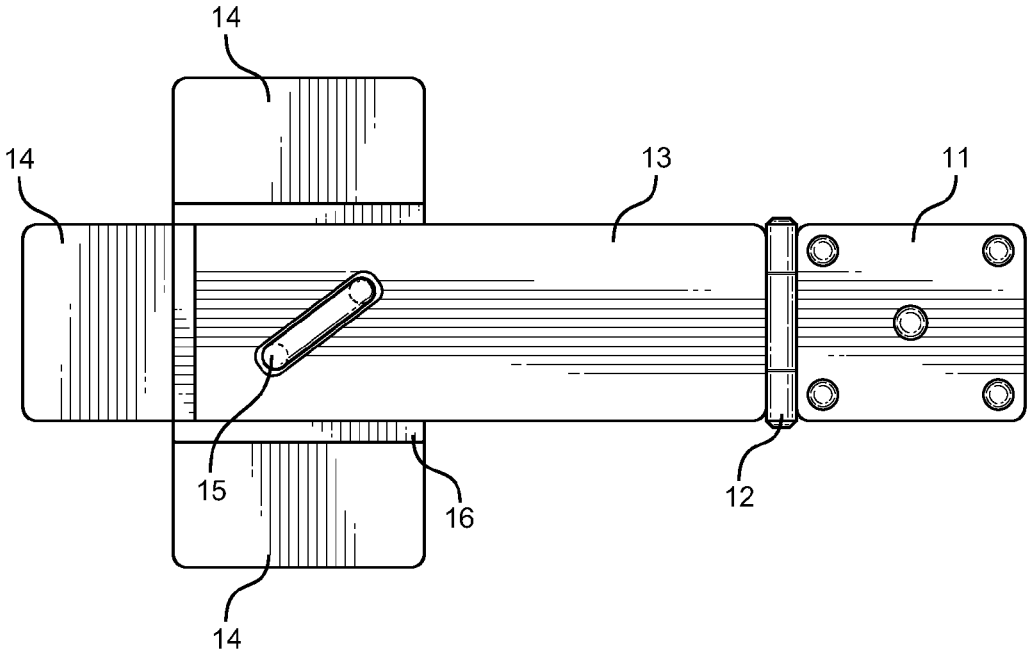
FIG. 1 shows a front view of the security hasp in an engaged position.

Reference is made herein to the attached drawings. Like reference numerals are used throughout the drawings to depict like or similar elements of the security hasp. For the purposes of presenting a brief and clear description of the present invention, the preferred embodiment will be discussed as used for preventing cutting tool access to a padlock shackle when installed on a hasp device. The figures are intended for representative purposes only and should not be considered to be limiting in any respect.

Referring now to FIG. 1, there is shown a front view of the security hasp of the present intention in an engaged position. The hasp comprises several common elements, including a first surface engagement plate 11 and a hingeable arm 13 that spans a gap intended to be secured or prevented from opening. This usually entails the hingeable arm spanning a door jamb or gap between outwardly hinging double-door assemblies. Along the distal end of the hingeable arm 13 is a padlock hoop engagement hole for which to pass through a pad lock hoop 15 protruding from a second surface. The hingeable arm 13 rotates over the hoop when the first and second surfaces are aligned, wherein a padlock shackle may engage the hoop 15 once it is fed through the engagement hole, effectively locking the arm 13 between the shack and the hoop and securing the assembly together.

Also positioned at the distal end of the hingeable arm 13 is a plurality of upstanding shroud members 16 that form a protective sheath or barrier for a padlock shackle engaged through the padlock hoop 15. The upstanding members 16 form a three-sided barrier that surrounds a padlock shackle, preventing cutting tools and other mechanical devices from gaining access to the shackle when in position, preventing unwanted tampering or unauthorized access thereto. In an exemplary embodiment, and shown in all figures, the shroud members 16 are formed together and attached to the distal end of the hingeable arm 13 in a welding process wherein the shrouds comprise L-brackets having an upstanding portion 16 and an in-plane portion that form protruding wings 14 from the arm 13. The brackets are welded to the arm 13 and then welded to one another to form a unified structure that shrouds a padlock shackle within an interior enclosure defined by the upstanding portions. The wings 13 can be utilized for improved handling of the hingeable arm 13. Alternatively, the shroud members 16 are formed only of an upstanding portion and connected directly to the hingeable arm 13 and to one another, without additional material to form wing structures 14.

The padlock hoop engagement hole is positioned on the hingeable arm 13 of the hasp in such a way to facilitate access to the hoop 15 for an open padlock shackle. This allows an open shackle to easily engage the hoop 15 when the hoop is surrounded by the upstanding shrouds. The hoop is positioned at an angle with regard to the hingeable arm 13 length, wherein greater room is provided and interferences are eliminated with regard to placement of the shackle through the hoop 15 when locking the assembly into position. The shackle of the padlock forms an inverted U-shape, which is openable when not in a locked position. Once a shackle has been engaged through the hasp loop 15, it can be secured into the padlock body, wherein its open U-shape is closed, its position is secured and its overall length is reduced. The reduced length of the locked padlock is shrouded by the upstanding members 16 whether the padlock is positioned parallel or perpendicular to the hingeable arm 13.

Figure 2:
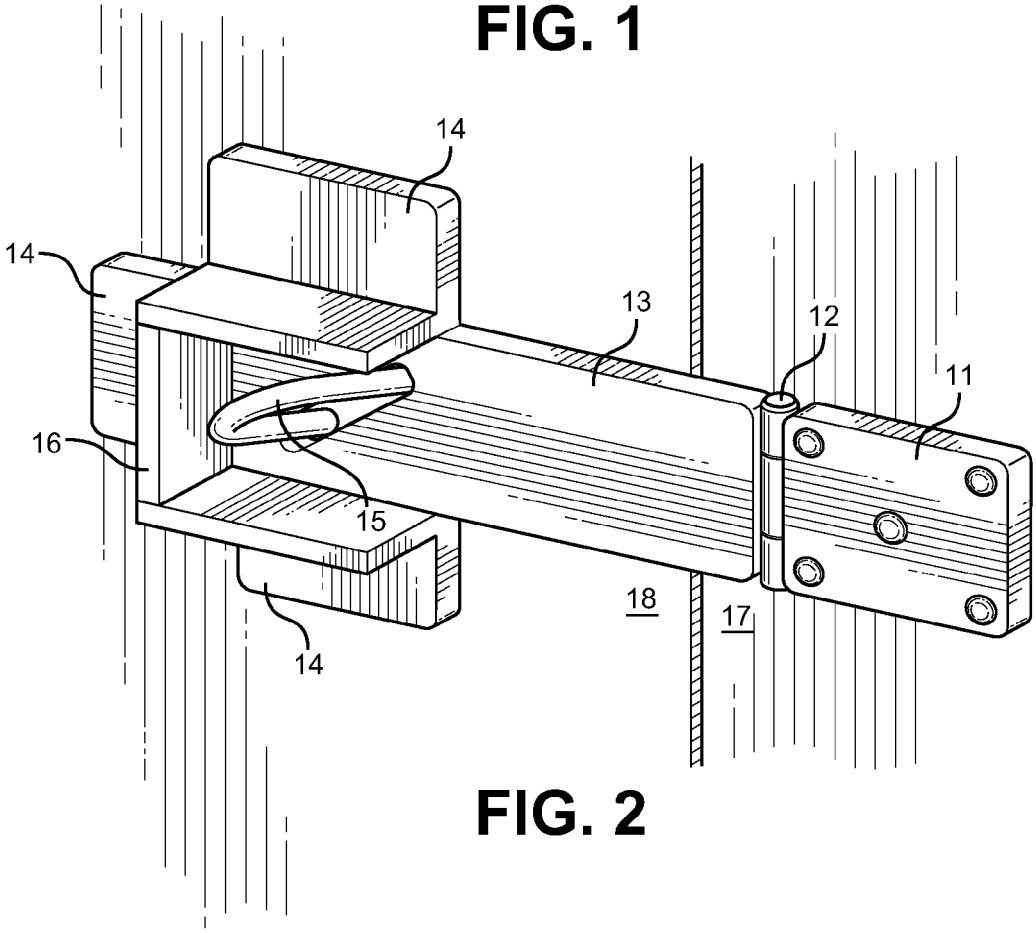
FIG. 2 shows a side perspective view of the security hasp in an engaged position.

Referring now to FIG. 2, there is shown a side perspective view of the security hasp of the present invention in an engaged position. The first surface engagement plate 11 is fastened or riveted to a first surface 17, while the hasp arm 13 hinges 12 therefrom and spans over a door jamb or door gap to engage a padlock hoop 15 located on a second surface 18. As shown, the engagement hoop 15 is positioned at an angle with regard to the hingeable arm, and is preferably at a forty-five degree angle measured from the hingeable arm. This allows adequate clearance within the interior of the shroud 16 to allow an open padlock clasp to engage the hoop 15 once the arm 13 has been placed thereover. The arm 13 and wings 14 of the L-bracket shroud embodiment lie flush against the second surface 18 when in an engaged and locked positioned, preventing the first 17 and second 18 surfaces from moving relative to one another and limiting access therethrough to unauthorized individuals. The upstanding shrouds 16 prevent individuals from using mechanical tools that would provide a mechanical advantage or cutting operation from gaining access to the hoop-engaged shackle. The presence of the device is designed deter would-be thieves, extend the time required to defeat the device or require the individual to utilize more complex means of circumventing the security hasp. The primary goal is to prevent bolt cutter access to the shackle, which is the quickest and quietest means to defeat exposed padlocks.

Figure 3:
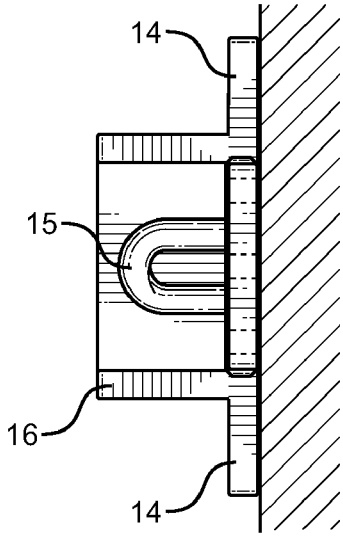
FIG. 3 shows a side view of the security hasp in an engaged position.

Referring now to FIG. 3, there is shown a side view of the security hasp of the present invention in an engaged position. The angle of the padlock hoop 15 is visualized, wherein a padlock shackle may be engaged therethrough along the interior portion of the upstanding shroud members 16. The shroud members 16 provide an enclosure around the hoop 15 that extends outward from the door or wall surface to enclose the shackle and hoop along their entire exposed length.

Figure 4:
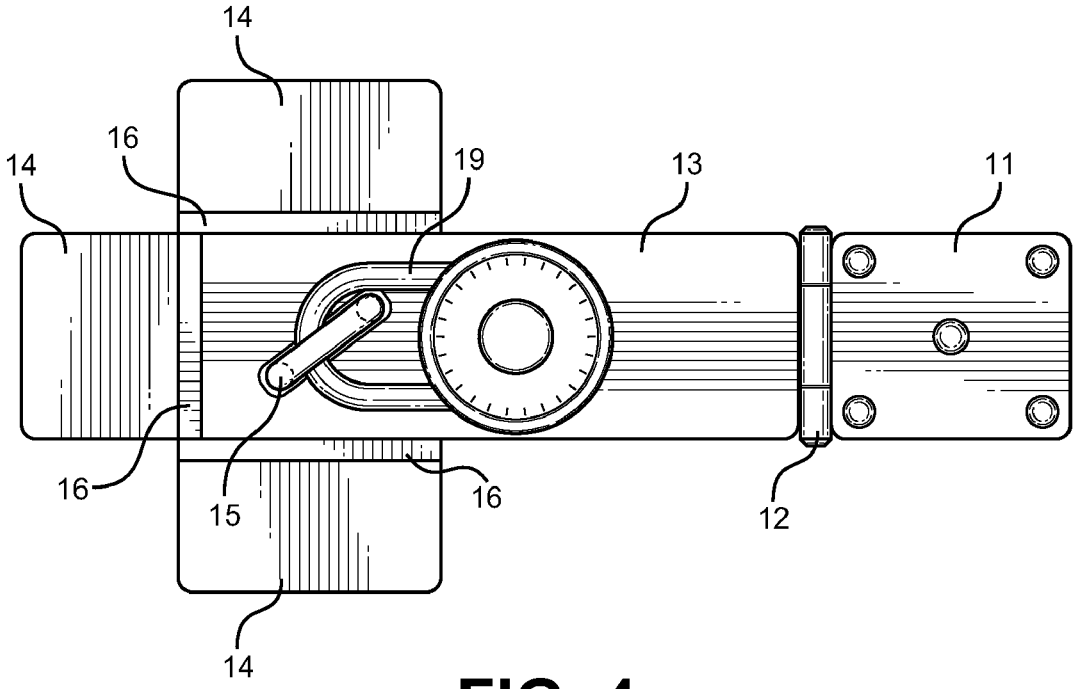
FIG. 4 shows a front view of the security hasp in an engaged position with a padlock in a locked and working position.

Referring finally to FIG. 4, there is shown a front view of the security hasp of the present invention with a padlock engaged in a locked position through the padlock hoop 15. The padlock shackle 19 is an inverted U-shaped that is adapted to fit through the hasp hoop 15 when in an open, unlocked configuration prior to being locked and secured thereon. The angle of the hoop 15 facilitates engagement, whereafter the shackle 19 can be locked into the body of the padlock or combination lock. The length and height of the shrouds determines the suitability and degree of protection afforded the padlock shackle. Elongated shrouds may prevent the use of shorter length shackles, as the shackle 19 may not be long enough to clear the shroud walls 16 once engaged on the hasp to permit locking into the padlock body. Conversely, larger shackle lengths that extend beyond the protection of the shroud members 16 will expose an area thereof of tampering or placement of cutting tools. It is desired to disclose a protective hasp that is adapted to be utilized with an appropriate length padlock shackle, such as commonly found in the art. The length and height of the shrouds 16 is adapted to accommodate this common length shackle 19, while the angle of the hoop 15 affords some repositioning and clearance when engaging the shackle onto the device.

An embodiment of the shroud members comprises a rounded edge in place of the exposed corner created along the open U-shape and outer surface of the shrouds. The rounded edge allows an engaged or locked padlock to transition from a position in parallel to the hingeable arm 13 to a perpendicular position with interference along the corner region of the shroud. The shackle 19 is afforded protective coverage in either a parallel or perpendicular configuration, and in any orientation therebetween. In use, the present device affords a level of security to exposed padlocks that is otherwise not provided, wherein the hasp comprises elements to deter unauthorized tampering and access for cutting tools to defeat the padlock shackle. The materials utilized in the construction of the device are preferably a hardened material that has a high strength, stiffness and surface hardness to limit one's ability to defeat the hasp and gain access to the padlock shackle.

With regard to the present disclosure, it is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A security hasp device for use with a padlock, comprising:

an engagement plate affixed to a first surface, a hasp arm hingeably attached to said engagement plate, spanning a gap to a second surface, said arm having a padlock hoop engagement hole;

a padlock hoop attached to said second surface and adapted to be engaged by said hoop engagement hole;

said hasp arm having a distal end further comprising a plurality of upstanding shroud members adapted to enclose said padlock hoop from three sides;

said shroud members comprising L-brackets that are affixed to said hasp arm distal end, each bracket connecting to said arm and to an adjacent bracket members to form said padlock hoop enclosure and a plurality of protruding wing structures from said hasp arm;

said padlock hoop oriented at an angle with regard to said hasp arm length to facilitate engagement of a padlock shackle and limit interference.

2. The device of claim 1, wherein said shroud members form a U-shape enclosure having a rounded outer edge to allow said padlock to be positioned in parallel, perpendicular or in any orientation therebetween without interference from said shroud when in a locked position.

3. The device of claim 1, wherein said padlock hoop is oriented at a forty-five degree angle with regard to said hasp arm.

4. A security hasp device for use with a padlock, comprising:

an engagement plate affixed to a first surface, a hasp arm hingeably attached to said engagement plate, spanning a gap to a second surface, said arm having a padlock hoop engagement hole;

a padlock hoop attached to said second surface and adapted to be engaged by said hoop engagement hole;

said hasp arm having a distal end further comprising a plurality of upstanding shroud members adapted to enclose said padlock hoop from three sides;

aid padlock hoop oriented at a forty-five angle with regard to said hasp arm length to facilitate engagement of a padlock shackle and limit interference.

* * * * *